US006216679B1

(12) United States Patent
Skinner et al.

(10) Patent No.: US 6,216,679 B1
(45) Date of Patent: Apr. 17, 2001

(54) IGNITION COIL FOR AN INTERNAL COMBUSTION ENGINE

(75) Inventors: Albert Anthony Skinner; James Alva Boyer, both of Anderson; Dwayne Allen Huntzinger, Pendleton, all of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/361,836

(22) Filed: Jul. 27, 1999

(51) Int. Cl.[7] ..... F02P 3/02; H01F 27/02

(52) U.S. Cl. ..... 123/635; 123/169 PA; 336/96; 29/602.1

(58) Field of Search ..... 123/634, 635, 123/169 PA; 336/96; 439/88, 89, 126, 127; 174/52.2; 29/602.1

(56) References Cited

U.S. PATENT DOCUMENTS 4,514,712 * 4/1985 McDougal ..... 336/96
4,960,099 * 10/1990 Shimada et al. ..... 123/647
5,685,282 * 11/1997 Murata et al. ..... 123/635
5,706,792 1/1998 Boyer et al. ..... 123/634
5,720,264 * 2/1998 Oosuka et al. ..... 123/634
5,949,319 * 9/1999 Nuebel et al. ..... 336/96
6,114,933 * 9/2000 Widiger et al. ..... 123/336

* cited by examiner

*Primary Examiner*—Andrew M. Dolinar
*Assistant Examiner*—Arnold Castro
(74) *Attorney, Agent, or Firm*—Margaret A. Dobrowitsky

(57) ABSTRACT

An ignition coil for an internal combustion engine improves high-voltage sealing performance and moreover reduces housing outer diameter. The ignition coil for an internal combustion engine is made up of a transformer portion of cylindrical configuration housed within a housing chamber of a case, a control-circuit portion, that is positioned on one end portion of this transformer portion, causing primary current of the transformer portion to be intermittent, and a connecting portion that is positioned on another end portion of the transformer portion, supplying secondary voltage of the transformer portion to a spark plug. A silicone rubber injection molding serves as the encapsulant while forming the high voltage boot to the plug.

15 Claims, 4 Drawing Sheets

IGNITION COIL FOR AN INTERNAL COMBUSTION ENGINE

TECHNICAL FIELD

The present invention relates to an ignition coil for an internal combustion engine, and more particularly, to an ignition coil for an internal combustion engine where the ignition coil is encased by a silicone rubber injection molding that serves to form the high-voltage boot to the spark plug.

BACKGROUND OF THE INVENTION

An ignition coil for an internal combustion engine that is installed directly on an engine and that is directly coupled with spark plugs is well known. Various configurations of such ignition coils for internal combustion engines have been proposed to achieve compactness and reduced weight. The ignition coil of the prior art is filled up around a coil portion, as fitted in a housing, with a thermoset resin (molding resin) such as an epoxy resin to prevent the high voltage generated by the coil portion from leaking out of the housing and causing a dielectric breakdown in the coil by the high voltage. Considering the adhesion between the inner wall of the housing and the molding resin, therefore, it is known to make the housing of a thermoplastic polyester resin such as polybutylene terephthalate (PBT) or polyethylene terephthalate (PET).

A device employing insulation material of insulating oil, epoxy resin, or the like to ensure insulation against high voltage is known, and the use of silicone rubber to encapsulate the coil is known.

However, demand for high output and high efficiency is increasing because the cylinder-head portions of engines are increasing in complexity because of adoption of more valves and improvements in combustion-chamber configuration. Space constraints for installation of the ignition coil is an increasing problem and concern. In the case of a DOHC engine in particular, increasingly narrower valve parting angles are being attempted, and the state is such that installation of a thick ignition coil is extremely difficult, and suitable dimensions which are housable within for example a plug hole are necessary.

Moreover, because the ignition coil is placed in the high-temperature environment immediately proximately to the engine body according to the foregoing prior art, there is a problem in which the insulating material is susceptible to temperature degradation. In particular, when the interior of the case is filled completely with insulating resin or oil, there is a problem whereby high-voltage durability declines due to oxidation and degradation of these materials.

SUMMARY OF THE INVENTION

To solve problems of the prior art such as the foregoing, it is an object of the present invention to provide an improved ignition coil for an internal combustion engine.

More particularly, it is an object of the present invention to provide an ignition coil for an internal combustion engine which is housed within a plug hole of an engine and mounted directly on the engine, and which maintains insulation performance against high voltage even with respect to engine heat and vibration.

An ignition coil according to the present invention uses an injection molded silicone rubber as the material for a housing of an ignition coil while at the same time forming the boot to the spark plug. In this way, durability can be improved as compared to the prior art structures.

More specifically, the invention utilizes liquid silicone as the encapsulant of a pencil coil forming the high voltage boot and the sealing feature at the low voltage end in the same molding operation. A case may be added for support and dielectric integrity, or the liquid silicone rubber may also form the case.

The progressive wound secondary may be required to be either pre-impregnated, trickle coated, or protected by tape because, while the pressures from liquid silicone rubber molding are significantly lower than typical thermal plastic molding, it still has the potential to damage the wires.

The wound primary with assembled connector is assembled to the wound secondary spool and then into the case. This assembly is then overmolded with liquid silicone rubber to form the boot to the plug and the sealing feature to the steel outer housing.

With this invention, oil can be eliminated as the encapsulant for the integrated plug/pencil coil. Liquid silicone rubbers have been formulated to withstand temperatures of greater than 300° C., which are 100° C. greater than silicone oil of gel. The cost of the liquid silicone rubber molding process described herein is significantly less than a conventional potting process.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENT

The preferred embodiments of the present invention are hereinafter described with reference to the accompanying drawings.

Figure 1:
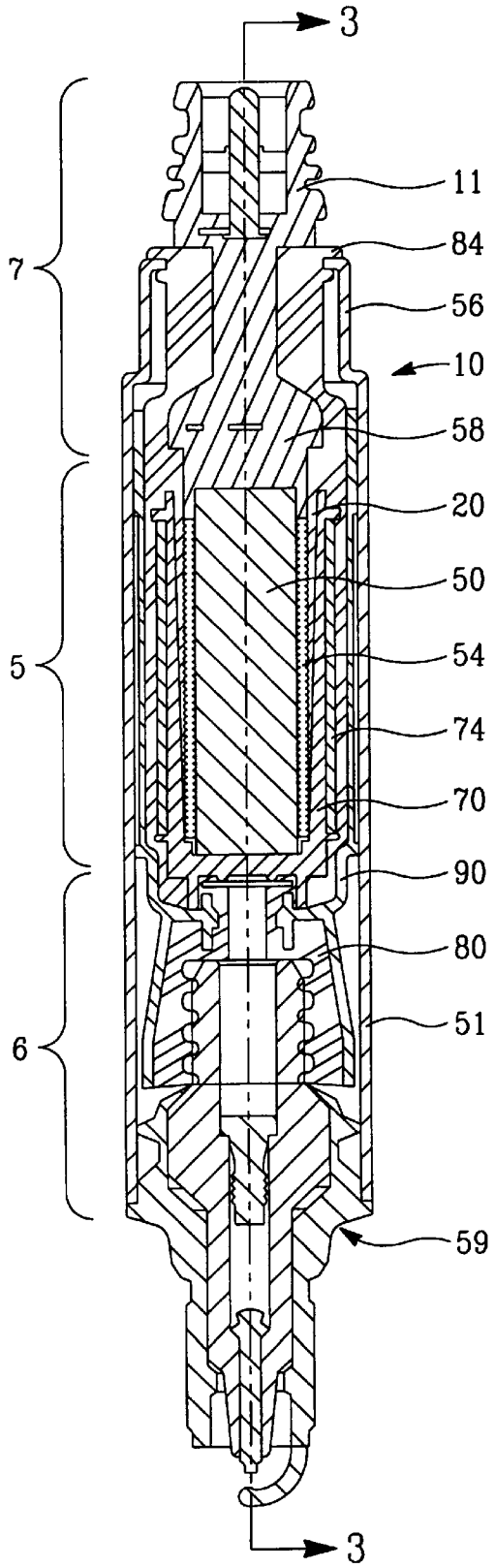
FIG. 1 is a longitudinal sectional view of an ignition coil for an internal combustion engine according to an embodiment of the present invention.

Referring to the figures, and particularly to FIG. 1, a preferred embodiment of an integrated ignition coil and spark plug assembly in accordance with the present invention is illustrated in partial sectional view and is generally designated by the reference numeral 10. The integrated ignition coil and spark plug assembly 10 is adapted for installation to a conventional internal combustion engine though a spark plug well and in threaded engagement with a spark plug opening into a combustion cylinder.

The assembly has a substantially rigid outer case 51 at one end of which is a spark plug assembly 59 and at the other end of which is a control circuit interface portion 11 for external electrical interface. The assembly further comprises a substantially slender high voltage transformer including substantially coaxially arranged primary and secondary windings and high permeability magnetic core. All high voltage ignition system components are housed or are part of the integrated ignition coil and spark plug assembly 10.

Generally, the structure is adapted for drop in assembly of components and sub-assemblies as later described.

As shown in FIG. 1, an ignition coil for an internal combustion engine is provided with a rigid outer case 51 composed of steel or resin material as a housing of the ignition coil. A transformer portion 5 and a control-circuit portion 7 as a coil portion for high-voltage generation are inserted in the case 51. The control-circuit portion responds to instruction signals from an external circuit (not shown) to cause primary current of the transformer portion 5 to be intermittent. A connecting portion 6 which supplies secondary voltage inducted from the transformer portion 5 to the spark plug is provided in a lower portion which is another end of the case 51.

The case 51 may be formed from round tube stock preferably comprising nickel plated 1008 steel or other adequate magnetic material. Where higher strength may be required, such as for example in unusually long cases, a higher carbon steel or a magnetic stainless steel may be substituted. A portion of the case 51 at the end adjacent the control circuit interface portion 11 is preferably formed by a conventional swage operation to provide a plurality of flat surfaces to provide a fastening head 56, such as a hexagonal fastening head for engagement with standard sized drive tools. Additionally, the extreme end is rolled inward to provide necessary strength for torque applied to the fastening head 56 and perhaps to provide a shelf for trapping Ting clip between the case 51 and the connector body 11. The previously assembled primary and secondary sub-assemblies are loaded into the case 51 from the spark plug end to a positive stop provided by the swaged end acting on a top end portion of the connector body.

The transformer portion 5 is formed around a central magnetic core 50. The magnetic core 50 of the transformer portion 5 may be manufactured from plastic coated iron particles in a compression molding operation. A binder of electrical insulating material carries the iron particles. In production of a part, the iron particles are coated with a liquid thermoplastic material that encapsulates the individual particles. The coated iron particles are placed in a heated mold press where the composite material is compressed to the desired shape and density. The final molded part is then comprised of iron particles in a binder of cured thermoplastic material. Because of the elongated shape of the core 50, the type of compression molding process utilized applies primary compressive forces normal to the major axis of the piece to provide uniform compaction throughout. Such core fabrication is generally preferred since cost effective round cross section cores may be produced thereby. After the core 50 is molded, it is finish machined such as by grinding to provide a smooth surface absent for example sharp mold parting lines otherwise detrimental to the intended direct primary coil winding thereon.

Laminating thin silicon-steel plates of differing widths so that a cross section thereof becomes substantially circular may also form the core 50. Magnets having polarity of reversed directions of magnetic flux generated by excitation by the coil are disposed respectively on both ends of this iron core 50.

The primary coil 54 is wound directly on the surface of the molded core 50. The windings are formed from insulated wire, which are wound directly upon the outer cylindrical surface of the core 50. The primary coil 54 may comprised two winding layers each being comprised of 127 turns of No. 23 AWG wire. Adhesive coatings, though not foreseeably needed, may be applied to the primary coil 54 such as by conventional felt dispenser during the winding process or by way of an injection of liquid silicone rubber about the wire. FIG. 1 shows a small layer of sealing 20 disposed about the primary coil 54. The winding of the primary coil 54 directly upon the core 50 provides for efficient heat transfer of the primary resistive losses and improved magnetic coupling which is known to vary substantially inversely proportionally with the volume between the primary winding and the core. The core 50 is assembled to the interior end portion of the connector body to establish positive electrical contact between the core 50 and the core-grounding terminal. The terminal leads (not shown) of primary coil 54 are connected to the insert molded primary terminals by soldering.

The primary sub-assembly is next inserted into the secondary spool 70. A secondary coil 74 is wound onto the outer periphery of the secondary spool 70. The secondary coil may be either a segment wound coil or a layer wound coil in a manner that is known in the art.

The control-circuit portion 7 is made up of a molded-resin switching element which causes conduction current to the primary coil to be intermittent, and a control circuit which is an igniter that generates the control signals of this switching element. Additionally, a heat sink, which is a separate body, may be glued to the control-circuit portion 7 for heat radiation of circuit elements such as the switching element.

The interior of the case 51 in which the transformer portion 5, connector portion 58 and high voltage boot 80 are housed is injected with liquid silicone rubber forming the high voltage boot 80 and the sealing member 84 that encapsulates the transformer portion 5 at the lower voltage end.

A case 90 may be added for support and dielectric integrity or the liquid silicone rubber may be allowed to also form the case 90 integral with the sealing member 84 and high voltage boot 80.

The progressive wound secondary coil 74 may be pre-impregnated, trickle coated, or protected by tape because, while the pressures associated with liquid silicone rubber are significantly lower than typical thermal plastic molding, it still may damage the wire.

For the assembly process, the wound primary coil 54 with assembled connector 58 is assembled to the wound secondary spool 70 and then into the case 90. This pre-assembly is then overmolded with liquid silicone rubber injected into the assembly.

Figure 4:
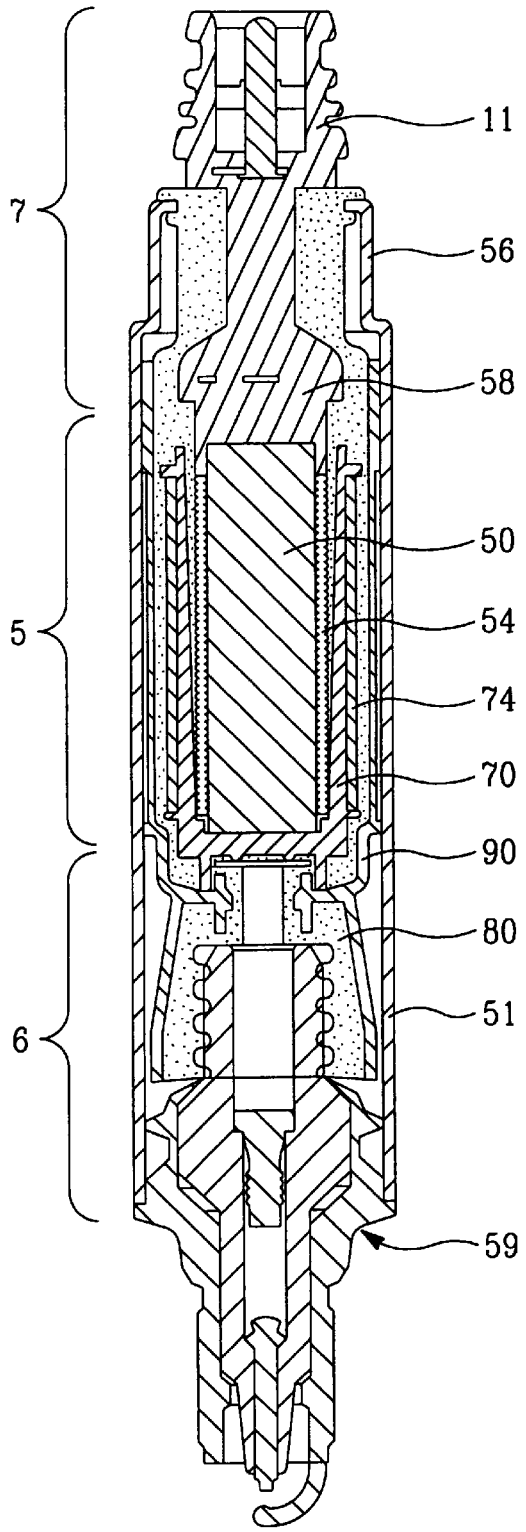
FIG. 4 is a longitudinal view of the ignition coil of FIG. 1 with the liquid silicone rubber shown with stippling.

FIG. 4 illustrates the pre-assembly with the liquid silicone shown with stippling. The liquid silicone rubber injected into the case forms the insulating material that fills in gaps formed respectively between the core 50, primary coil 54, secondary coil 74, inner walls of the case 51, and the like, and sealing of high voltage generated from the secondary coil 68 is performed by this insulating material. The insulating liquid silicone rubber also penetrates via a lower-side open end of the secondary spool 70 and forms the high voltage boot 80, thereby causing electrical insulation around the iron core 50, primary coil 54, secondary spool 70, the secondary coil 74 and high voltage boot 80.

Figure 2:
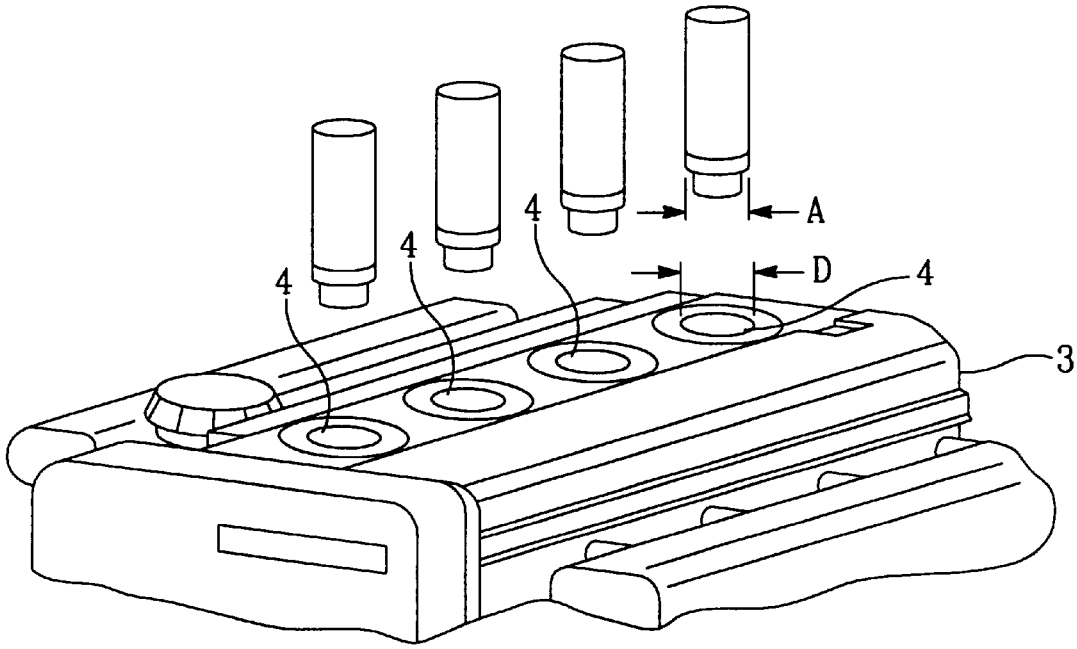
FIG. 2 is a perspective view indicating an ignition coil for an internal combustion engine according to an embodiment of the present invention and a plug hole of an engine cover.
Figure 3:
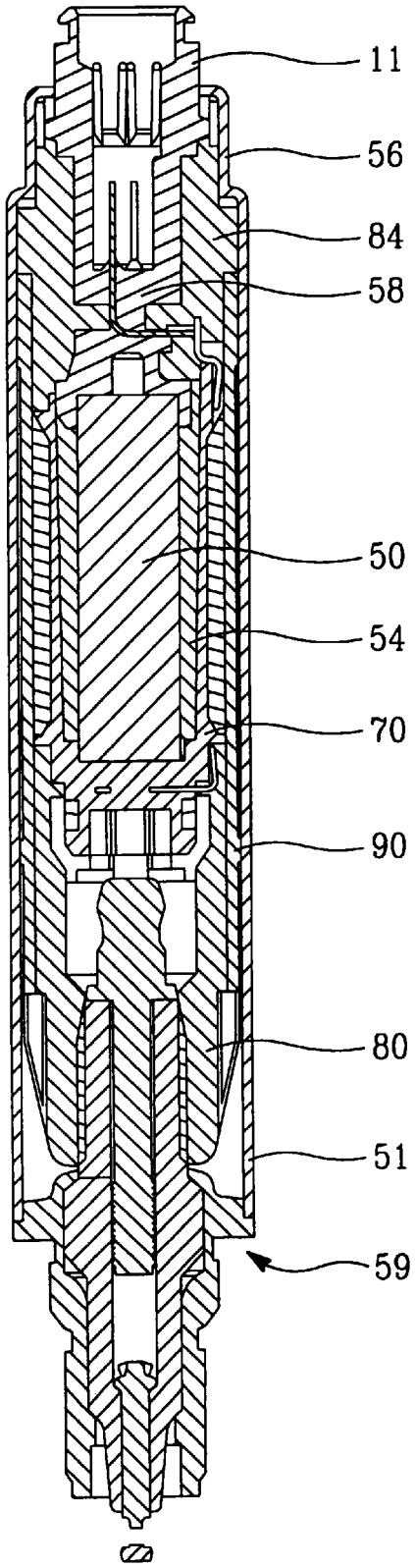
FIG. 3 is a longitudinal sectional view of the ignition coil of FIG. 1 as view along section line III—III.

The above-described ignition coil is inserted in a plug hole of an internal combustion engine as indicated typically in FIG. 2, and is fixed to an engine head 3 by a bolt (not shown) provided through a collar. A spark plug 59 mounted on a bottom portion of the plug hole is received within the connecting portion 7, and a head-portion electrode of the spark plug electrically contacts an end portion of the transformer portion 5.

It is essential that this ignition coil have a cross-sectional configuration and dimensions that are housable within the plug hole, as shown in FIG. 2. According to this embodiment, a tube-portion cross section of the case 51 is formed to be circular so that an inner-diameter dimension D accommodates a plug hole, and an outer diameter A thereof is established to be a suitable dimension as recognized by those skilled in the art.

In such an ignition coil, gaps and distances between components that make up the transformer portion 5 become smaller to house the transformer portion 5 within the narrow housing chamber 102. In a case where hard insulating resin was disposed between the components, therefore, there was susceptibility to cracking and a chance of occurrence of defective insulation due to thinness thereof. In contrast to this, insulating silicone rubber is utilized according to the foregoing embodiment, and so occurrence of defective insulation is prevented even with long-term usage.

According to the present invention, high-voltage sealing performance of an ignition coil for an internal combustion engine can be improved by injecting the ignition coil assembly for an internal combustion engine with insulating liquid silicone rubber. Thereby, case outer diameter of the ignition coil for an internal combustion engine can be established reduced, and the ignition coil for an internal combustion engine can be housed within a plug hole. Additionally, because case outer diameter of the ignition coil for an internal combustion engine can be narrower than an ignition coil for an internal combustion engine according to the prior art, volume of the ignition coil for an internal combustion engine can be reduced with respect to an ignition coil for an internal combustion engine according to the prior art which utilizes thermosetting resin as insulating material, and the weight of the ignition coil for an internal combustion engine is reduced.

Additionally, according to the present invention, the configuration of the case of the ignition coil for an internal combustion engine was made to be circular, but the present invention is not exclusively restricted to this, and an axial cross-sectional configuration formed in a tubular configuration which is pentagonal, octagonal, or otherwise polygonal is also acceptable.

Still further, according to the present invention, the ignition coil for an internal combustion engine was mounted in a plug hole 4 formed in an engine head cover 3, but the present invention is not exclusively restricted to this, and an ignition coil for an internal combustion engine which is mounted via a bracket or the like installed on an engine head cover is also acceptable.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An ignition coil for an internal combustion engine, said coil comprising:

a transformer portion comprising a first coil and a second coil;

a control circuit interface portion for said transformer portion to a control circuit;

a connecting portion for connecting a spark plug to said ignition coil;

a case at least partly surrounding said connecting portion, said transformer portion and said control circuit interface portion;

injection molded liquid silicone rubber insulating at least a part of said connecting portion, said transformer portion and said control circuit interface portion.

2. The coil of claim 1, wherein said injection molded silicone rubber flows around said first and second coils and around said connecting portion.

3. The coil of claim 1, wherein said injection molded silicone rubber flows around said first and second coils and around said control circuit portion.

4. The coil of claim 1, wherein said control circuit portion is positioned adjacent a first end of said transformer portion.

5. The coil of claim 2, wherein said control circuit interface portion delivers a primary current from a control circuit to the transformer portion, and wherein said control circuit causes said primary current to be intermittent.

6. The coil of claim 1, wherein said connecting portion is positioned adjacent a second end of the transformer portion opposite said first end.

7. The coil of claim 4, wherein said connecting portion supplies a secondary voltage of the transformer portion to a spark plug.

8. The coil of claim 1, wherein a secondary case is interposed between said case and said transformer portion to provide support and dielectric integrity.

9. The coil of claim 1, wherein said injection molded silicone rubber is injected into an end of said case at said control circuit portion and flows through said case to said connecting portion.

10. The coil of claim 1, wherein said injection molded silicone rubber is interposed between said primary coil and said secondary spool.

11. An ignition coil for an internal combustion engine comprising:

a tubular case having a first end for accepting a head of a spark plug, and a high voltage boot portion for connecting said spark plug head to said case;

a coil portion disposed within said case; and injection molded liquid silicone rubber injected into said case to encapsulate and insulate said coil portion and said high voltage boot portion.

12. The ignition coil of claim 11, wherein said injection molded silicone rubber further encapsulate a control circuit interface portion connecting said coil portion to a control circuit.

13. The ignition coil of claim 11, wherein said injection molded silicone rubber flows between a primary coil and a secondary spool of said coil portion.

14. A method of forming an ignition coil for an automobile, comprising the steps of:

disposing a coil transformer portion into a case;

injecting liquid silicone rubber into said case such that said liquid silicone rubber flows between said coil transformer portion and said case.

15. The method of claim 14, wherein said liquid silicone rubber further forms a connector portion connecting said transformer portion with a control circuit causing conduction current to the transformer portion to be intermittent.

* * * * *